US006957671B2

(12) United States Patent
Pannekoucke et al.

(10) Patent No.: US 6,957,671 B2
(45) Date of Patent: Oct. 25, 2005

(54) DEVICE FOR CREATING A GAUZE FABRIC

(75) Inventors: Johan Pannekoucke, Ypres (BE); Bernard Vancayzeele, Ypres (BE); Geert Geerardyn, Nieuwkerke (BE); Norbert Hollevoet, Geluveld (BE)

(73) Assignee: Picanol, N.V., Ypres (BE)

( * ) Notice: Subject to any disclaimer, the term of this patent is extended or adjusted under 35 U.S.C. 154(b) by 75 days.

(21) Appl. No.: 10/312,559

(22) PCT Filed: Jul. 6, 2001

(86) PCT No.: PCT/EP01/07761

§ 371 (c)(1),
(2), (4) Date: Apr. 17, 2003

(87) PCT Pub. No.: WO02/04723

PCT Pub. Date: Jan. 17, 2002

(65) Prior Publication Data

US 2003/0159746 A1 Aug. 28, 2003

(30) Foreign Application Priority Data

Jul. 12, 2000 (BE) ..... 2000/0443

(51) Int. Cl.[7] ..... D03C 7/00
(52) U.S. Cl. ..... 139/50
(58) Field of Search ..... 139/50, 53, 52; 66/206, 208

(56) References Cited

U.S. PATENT DOCUMENTS 1,543,045 A * 6/1925 Bachman et al. ..... 139/50
1,776,102 A * 9/1930 Brooks ..... 139/53
4,429,722 A 2/1984 Herzog
6,092,398 A * 7/2000 Matsuda ..... 66/208
6,382,262 B1 * 5/2002 Herzig ..... 139/50
6,510,871 B2 * 1/2003 Baumann et al. ..... 139/50
6,851,456 B2 * 2/2005 Baumann ..... 139/50

FOREIGN PATENT DOCUMENTS

| | | |
|---|---|---|
| CH | 579162 A | 8/1976 |
| DE | 466340 C | 9/1928 |
| DE | 646462 C | 6/1937 |
| EP | 0534629 A | 3/1993 |
| EP | 1101850 A | 5/2001 |
| WO | 98 07913 A | 2/1998 |

* cited by examiner

*Primary Examiner*—John J. Calvert
*Assistant Examiner*—Andrew W. Sutton
(74) *Attorney, Agent, or Firm*—Bacon & Thomas PLLC

(57) ABSTRACT

Apparatus for producing a leno fabric includes a plurality of juxtaposed stationary needles (1) each fitted with one guide eye for a single warp and in addition a device (13) fitted with a plurality of juxtaposed warp guide eyes, the device (13) being displaceable relative to the stationary needles (1) along the needles' longitudinal direction and transversely thereof. The guide-eyes fitted device (13) is guided during longitudinal displacements along the longitudinal direction of the needles and along respective transverse displacements by guides (18).

10 Claims, 12 Drawing Sheets

DEVICE FOR CREATING A GAUZE FABRIC

BACKGROUND

1. Field of the Invention

The invention relates to leno-weaving apparatus including a plurality of juxtaposed needles each comprising a guide eye for a warp, and a plurality of juxtaposed devices defining guide eyes for warps and for moving these warps relative to the stationary needles transversely relative to their longitudinal direction as well as along the longitudinal direction of the needles.

2. Related Art

Known apparatus of the above described kind is disclosed in German patent document 466,340, wherein a harness is used as the device which is displaced parallel to and transversely relative to the needles, said harness being fitted with two mutually oppositely displaceable perforated rails suspended within a frame from leaf-spring bars that flex during said transverse motions.

Additionally, it is also known from the patent documents CH 579,162; FR 2,174,675 and WO 98/07913 to displace the said device fitted with the plurality of guide eyes relative to the needles with their respective guide eyes.

The objective of the present invention is to provide apparatus of the above-described kind which is capable of high weaving rates and which avoids the danger of vibration-induced defects.

BRIEF SUMMARY OF THE INVENTION

The invention solves this problem by guiding, by appropriate guidance elements, the devices that move jointly with the guide eyes both during the longitudinal motions taking place along the longitudinal direction of the needles and during the respective transverse motions.

As a result, neither the needles nor the plurality of devices fitted with guide eyes will vibrate longitudinally or transversely, such vibrations degrading weaving quality.

Advantageously the design of the present invention calls for needles pointing from top to bottom and serving to receive the warps of a sheet of warps constituting the lower side of a weaving shed. Thereby the drive systems, in particular drives for the up-and-down motions of the displaceable device, may be mounted at the bottom, that is in a position typically receiving the harness drives. Consequently said device may be powered by an actuator similar to a harness drive.

In a further embodiment of the invention, a drive system is used with its own drive motor to implement the transverse motions. As a result, the leno weaves may be changed without requiring substantial machine adjustments. Moreover such a drive motor also allows implementing the motions of the device fitted with the plurality of guide eyes at times when the warps guided therein do not rest against the stationary needles. In this manner the danger of driving the needles into vibration is reduced. Furthermore the likelihood of needle wear is thereby lowered.

In one desired embodiment, the drive system is preferably designed as an adjustable cam drive. As a result, the relative positions of the needles and of the guide eyes of the device are mutually adjustable.

Further features and advantages of the invention are set forth in the description below of the embodiments shown in the drawings.

DETAILED DESCRIPTION OF THE PREFERRED EMBODIMENTS OF THE INVENTION

Figure 1:
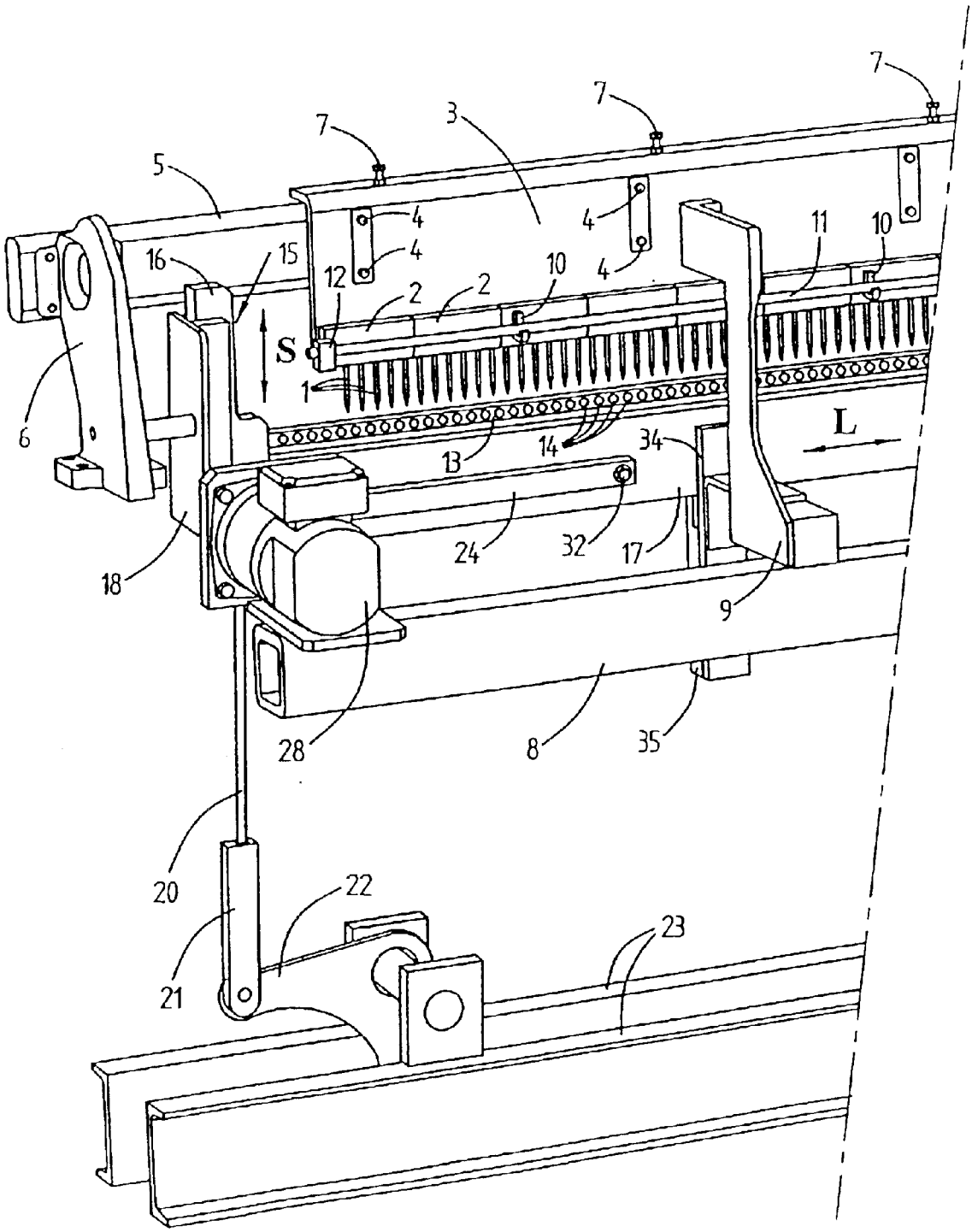
FIG. 1 is a schematic of part of a weaving machine comprising a system according to the invention.

The apparatus according to the invention is shown in FIG. 1 as being part of a weaving machine and comprises a plurality of needles 1 uniformly distributed across the weaving machine's width. Each set of needles 1 is mounted in a support 2. The supports 2 are exchangeably affixed one behind the other on a support plate 3 affixed by screws 4 to a crossbeam 5. The crossbeam 5 runs across the full width of the weaving machine and is mounted by brackets 6 to a side frame (not shown) of the weaving machine. The elevation of the needles can be adjusted by adjustment screws 7 affixed on a bent over flange of the support plate 3 that rests on the crossbeam 5. The adjustment screws enable changing the position of the support plate 3 relative to the crossbeam 5.

The weaving machine includes another crossbeam 8 also running across the full width of the weaving machine and which is affixed to the weaving machine's side frame. Braces 9 are mounted at regular intervals between the support plate 3 and the second crossbeam 8 in order to limit excessive bending of the support plate and the crossbeams 5 and 8.

Supports 10 are affixed at regular spacings, for instance by screws (not shown), to the support plate 3, said screws extending through the supports 2 into the support plate 3. A deflecting rod 11 deflecting the warps guided by the guide eyes of the needles rests on said supports 10. The deflecting rod 11 is affixed by a clamp 12 at a defined axial position on the support plate 3.

Figure 2:
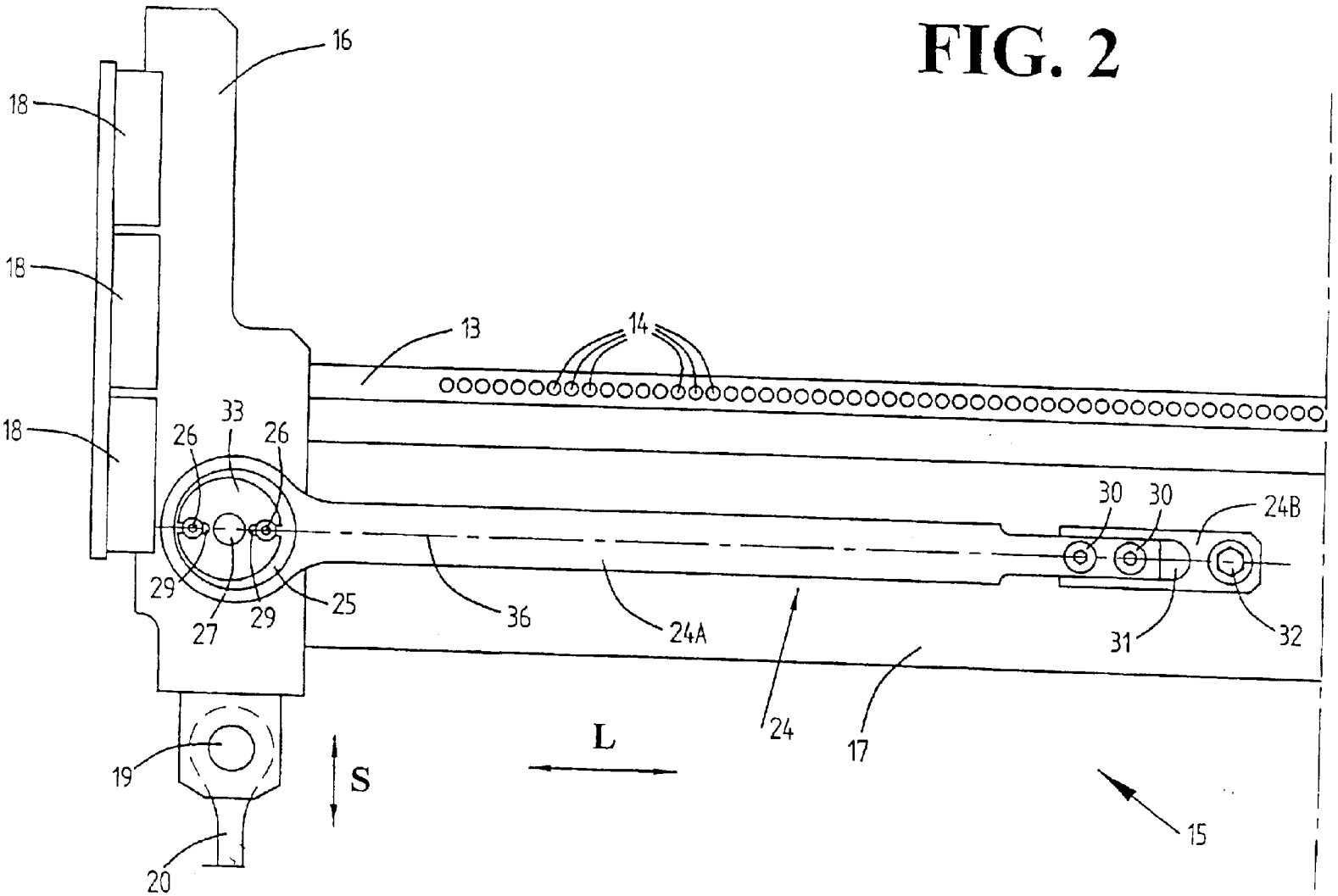
FIG. 2 is a partial view of the embodiment of FIG. 1.

As shown in FIGS. 1 and 2, in addition to the needles 1 fitted with warp guide eyes, a strip-like warp moving device 13 is provided and comprises a plurality of warp guide eyes 14. Said device 13 substantially runs across the full weaving-machine width. The distance between the guide eyes 14 of the device 13 corresponds to the spacing between the needles 1, that is, the spacing between the guide eyes of the needles 1. The device 13 is firmly affixed in a frame 15 comprising two lateral parts 16 connected by the device 13 and a cross-brace 17 of larger diameter. The lateral parts 16 are guided within guides 18 and as a result the frame 15 is displaceable up and down in one plane and to-and-fro laterally, said plane extending substantially perpendicularly to the warps. In the shown embodiment, the frame 15 is connected in the region of the lateral parts 16 by a linkage 19, connecting rods 20, 21 and a lever 22 to a drive system (not shown) implementing up-and-down motions of the frame 15. The levers 22 of both sides rest conventionally on crossbeams 23 of the weaving machine. The said drive system may be a conventional one for weaving-machine harnesses. Such a drive system for example contains a set of cams that are able to move the frame 15 between two consecutive filling insertions from an uppermost position to a lowermost position and back into the uppermost one. The cam set may be configured in such a way that the upward motion and the downward motion each shall be implemented by specific, individual cams. Using such a drive system, the device 13 may be moved upward and downward in a plane S determined by the guides 18 and running substantially perpendicularly to the warps.

The device 13 is moved to-and-fro parallel to the row of needles 1 by means of a drive system which in this embodiment is a cam drive system. In the illustrated embodiment, a connecting rod 24 links up with the cross-brace 17 of the frame 15 and is driven by means of a cam 25 on the drive shaft 27 of an adjustable drive motor 28 so that the device 13 is moved to-and-fro in the direction of the arrow L. In this embodiment the drive motor 28 is affixed to the crossbeam 8. Illustratively said motor is an adjustable, switched reluctance motor. The cam 25 is affixed by screws 26 on a disk 33 that is irrotationally affixed to the drive shaft 27. When the screws are loosened, the cam 25 may be displaced in slots 29 of the disk 33 and they may be affixed by tightening the screws 26 in a predetermined radial position on the said disk 33. As a result, the excursion of motion may be adjusted, for instance as a function of the spacing between the guide eyes 14 of the device 13. As also shown in FIG. 2, the connecting rod consists of two parts 24A and 24B that may be linked to each other using screws 30 and slots 31 so as to assume various axial positions, thereby allowing adjusting the length of the connecting rod 24. Consequently the position of the guide eyes 14 of the device 13 may be adjusted in the lateral direction relative to the needles 1. The connecting rod 24 is linked by an articulation 32 to the cross-brace 17. The cross-brace 17 is guided by several longitudinally distributed guides 34, 35 associated with the braces 9 and which prevent the cross-brace 17 from flexing in the direction of the warps. In the shown embodiment, the drive shaft 27 and the connecting rod 24 are situated very nearly in a horizontal plane 36 when said device 13 is situated between its uppermost and its lowermost positions. In that case the connecting rod will extend substantially parallel to the cross-brace 17. When the device 13 assumes its lowermost position, the warps it guides shall be situated underneath the needles 1 and accordingly shall not rest against the stationary needles 1.

Figure 3:
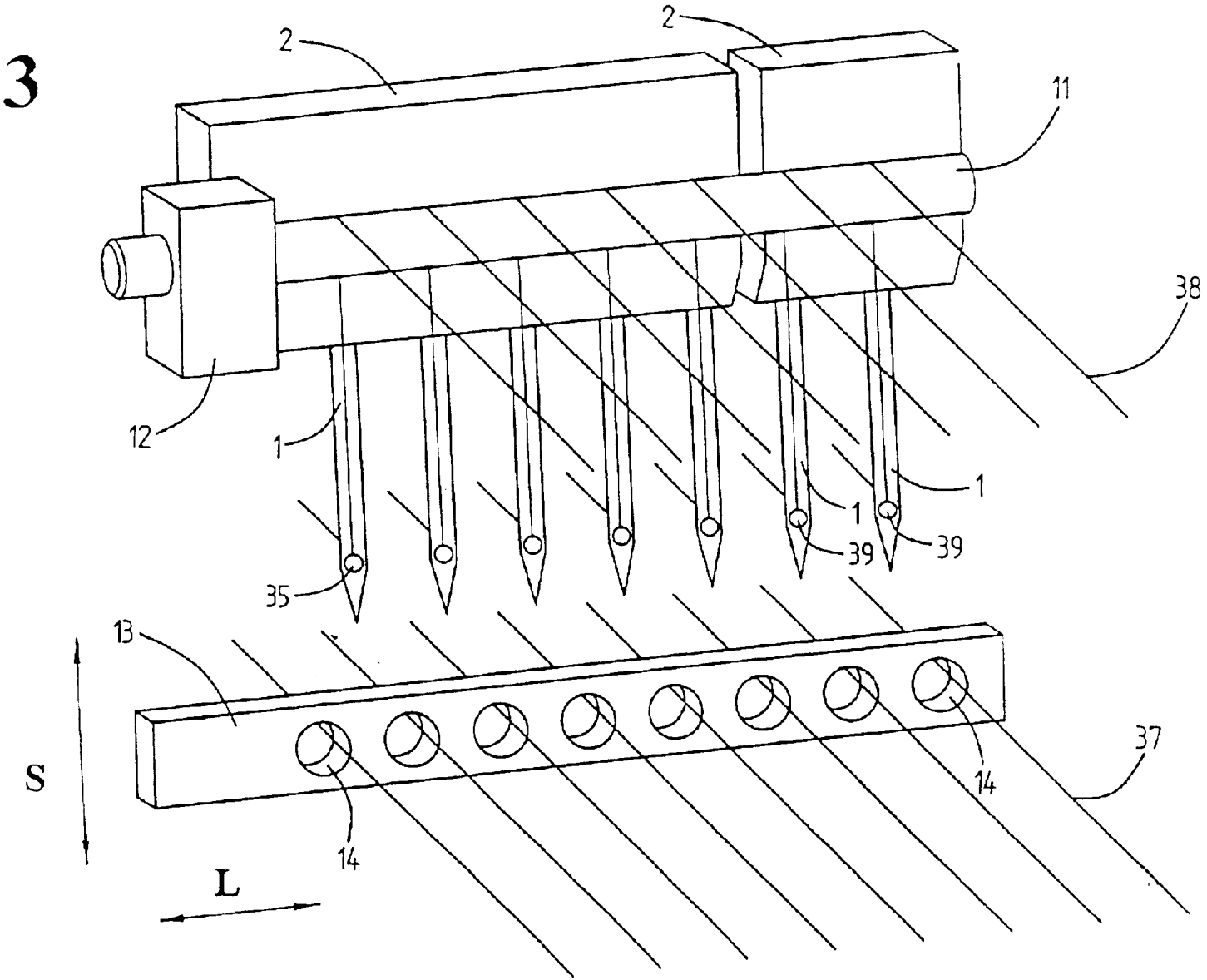
FIG. 3 is an enlarged view of components shown in FIG. 1.

As shown by FIG. 3, one sheet of warps 37 is guided by the guide eyes 14 of the device 13. The other sheet of warps 38 runs over the deflection rod 11 through the guide eyes 39 of the needles 1. The warps of the sheets 37, 38 are guided from a warp beam (not shown), illustratively an elastically supported back beam, to the apparatus of the present invention. Where called for, further means compensating tension variations in the warps of the sheets 37, 38 may be provided between the back beam and the system of the invention.

Figure 4:
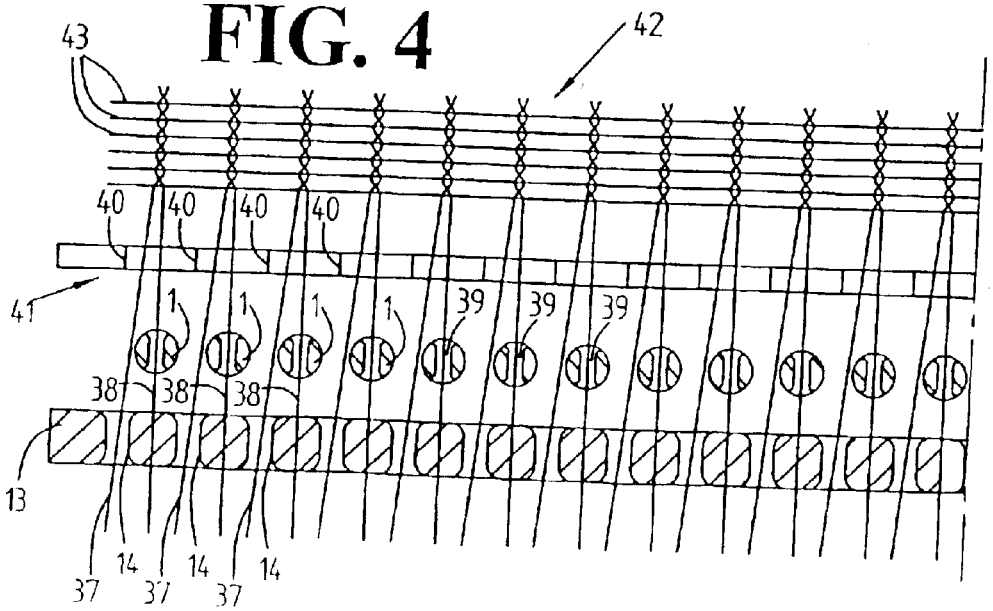
FIG. 4 is a schematic view of an approximately horizontal section of FIG. 1.

As shown in FIG. 4 in each instance one warp of the sheet of warps 37 and one warp of the sheet of warps 38 are guided between two teeth 40 of a reed 41. These warps guided between two reed teeth 40 are intended for a leno weave. The result is a leno fabric 42 after fillings 43 having been correspondingly inserted.

Figure 5:
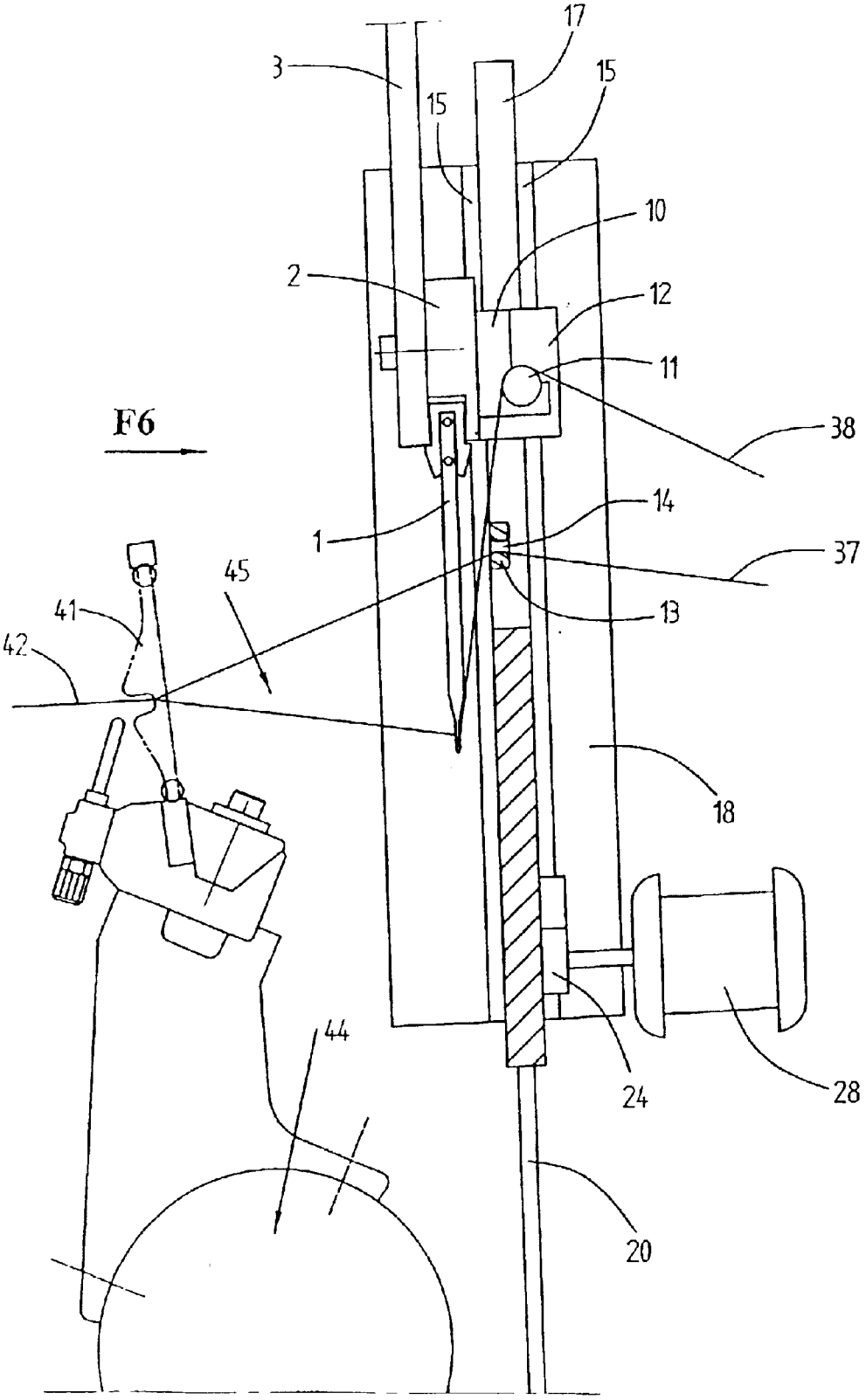
FIG. 5 is partly sectional side view of the equipment of the invention in a first position.

As shown in FIG. 5, the reed 41 is mounted on a lay 44. The sheets of warps 37 and 38 constitute a shed 45, the lower warp sheet 38 of the shed 45 being constituted by those warps which are guided by the stationary needles 1. The upper warp sheet 37 is constituted by those warps that are guided by the device 13.

Figure 6:
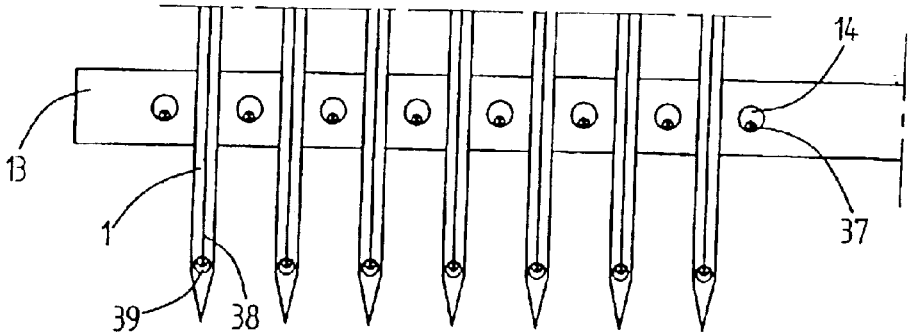
FIG. 6 is as schematic view in the direction of the arrow F6 of FIG. 5, FIGS. 7, 8 are views corresponding to FIGS. 5, 6 in consecutive positions.
Figure 8:
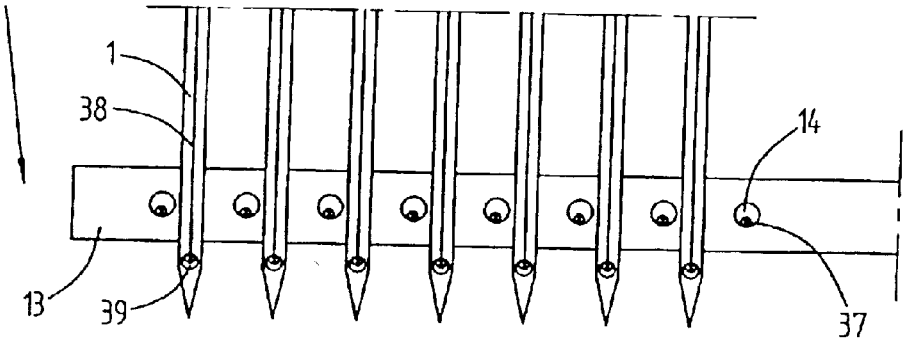
Figure 10:
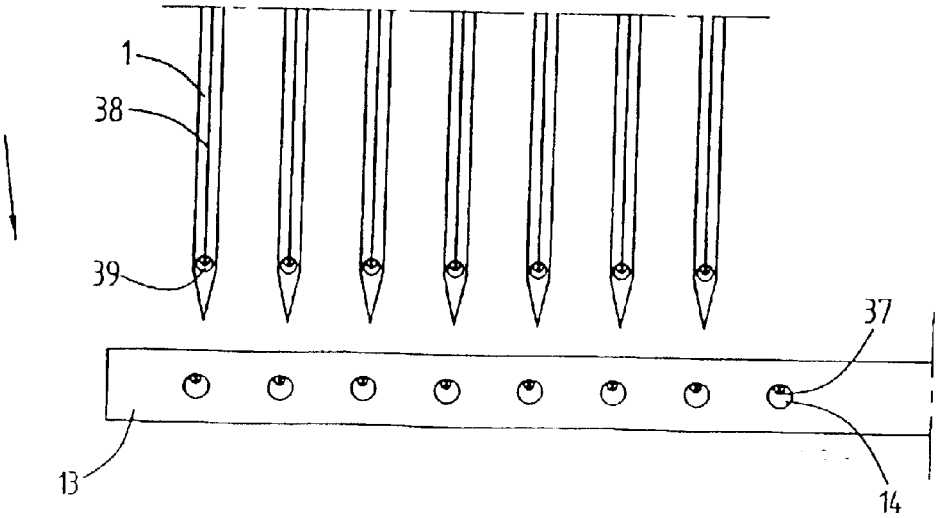
FIGS. 9, 10 are views corresponding to FIGS. 7, 8 in further consecutive positions.
Figure 7:
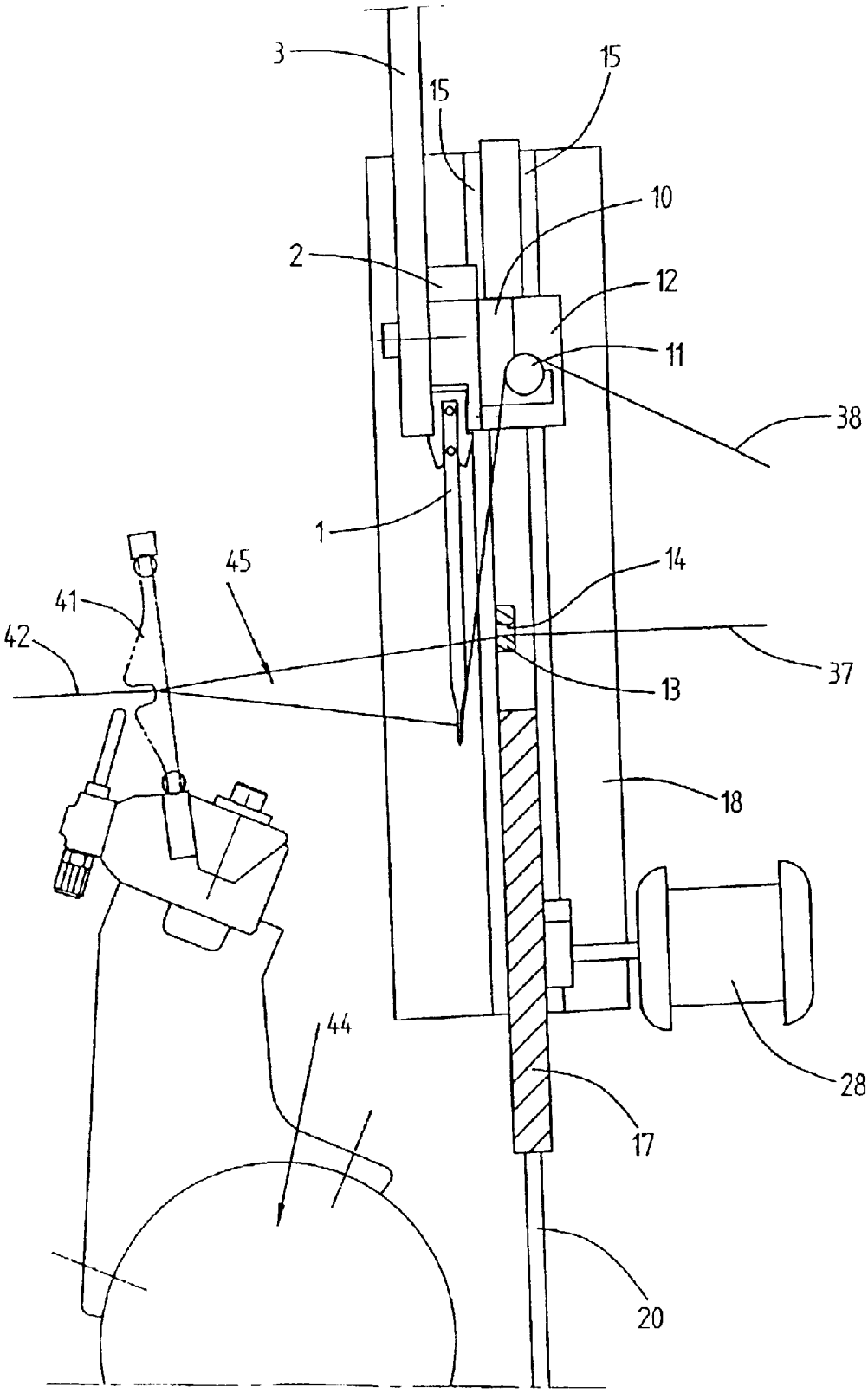
Figure 9:
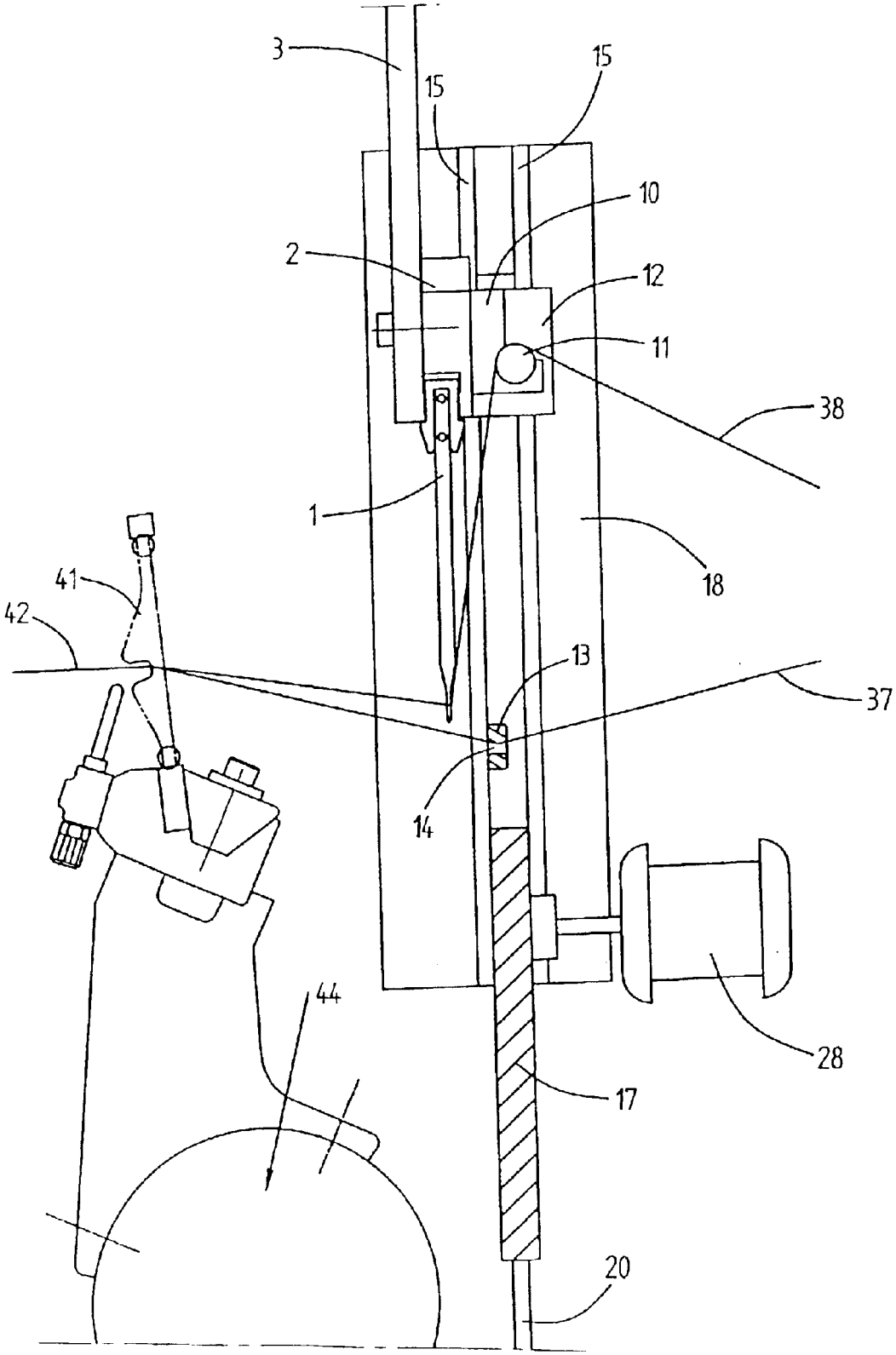
Figure 11:
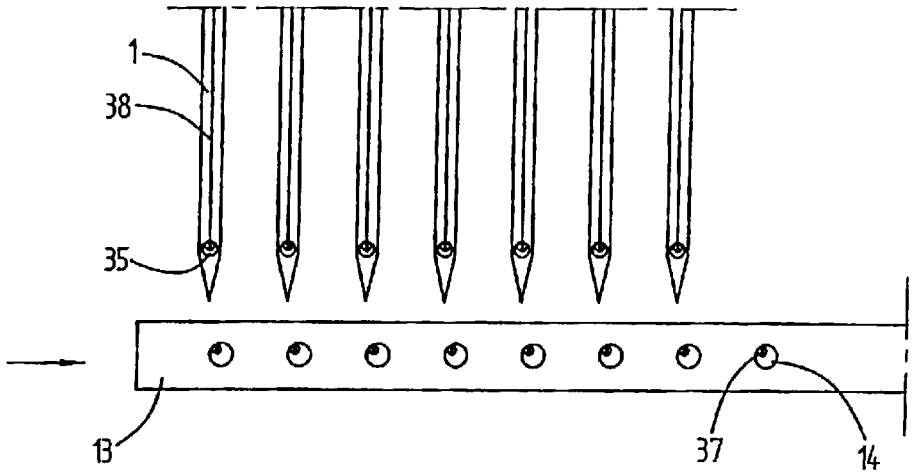
FIG. 11 is a view corresponding to FIG. 10 in a further consecutive position.
Figure 13:
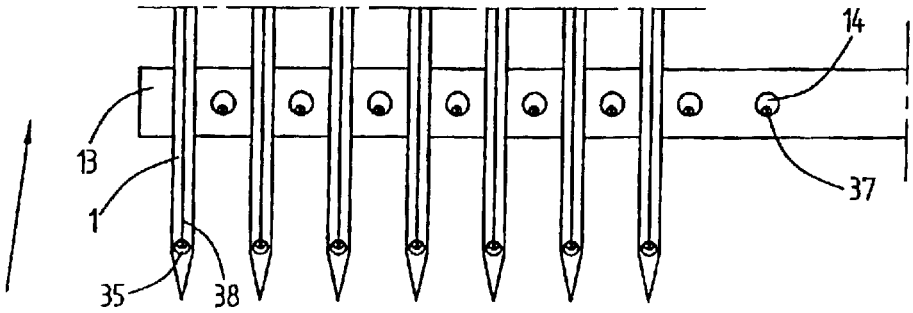
FIGS. 12, 13 are views corresponding to FIGS. 9, 11 in further consecutive positions.
Figure 12:
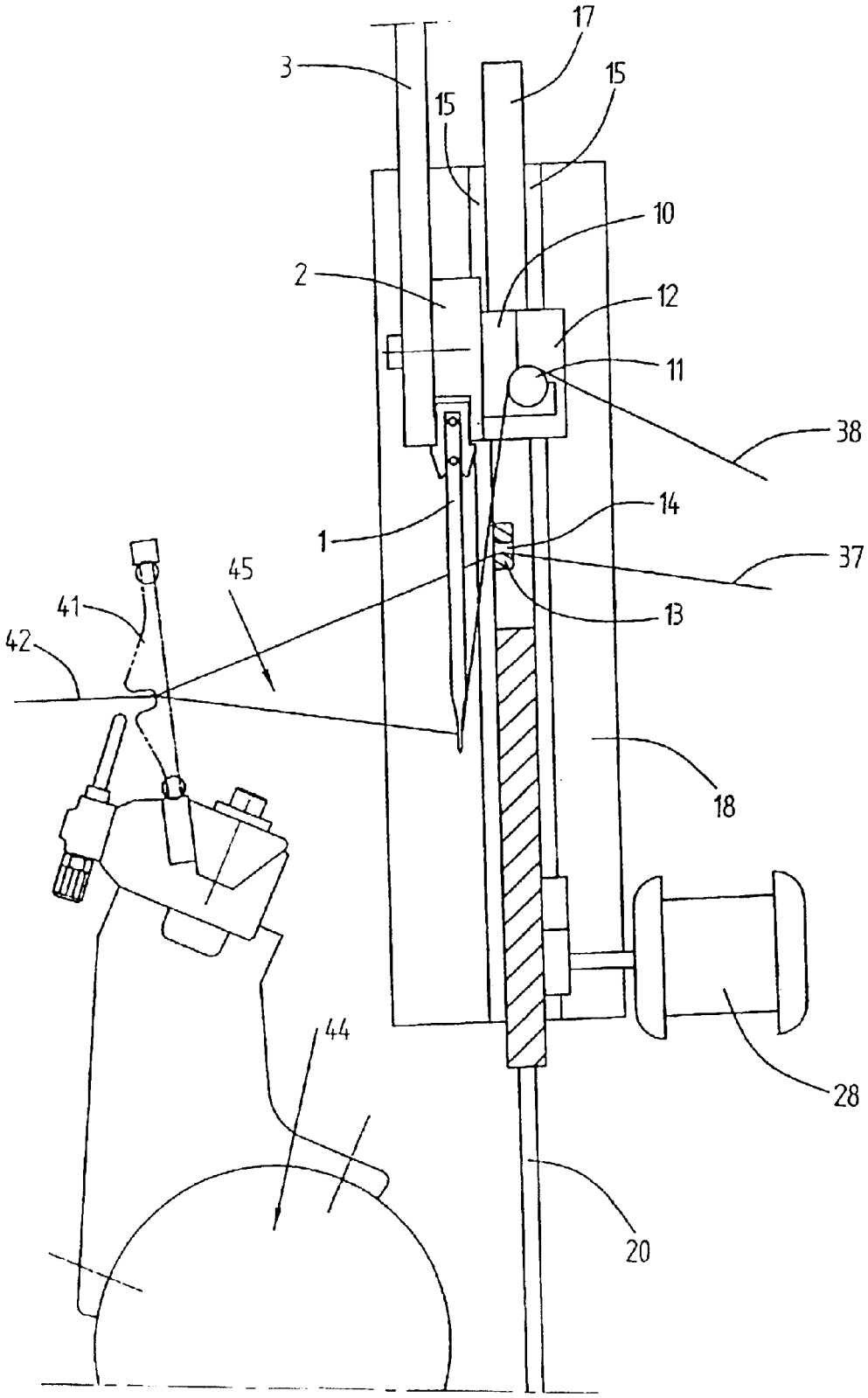

Illustratively, when weaving and starting from the position shown in FIGS. 5 and 6, wherein the warps of the warp sheets 37 are in their uppermost position and to the left of the associated needles 1, the device 13 will be displaced downward. During this motion said device 13 may be laterally displaced together with the warps of the sheet 37 by the drive motor 28 toward the needles 1 as shown in FIGS. 7 and 8. During further motion into the position shown in FIGS. 9 and 10, further lateral displacement of the device 13 as shown in FIG. 11 permits moving the warps of the warp sheet 37 to the other side of each respective needle 1. In the course of a subsequent upward motion of the device 13, the warps of the sheet 37 shall stay on this side of the respective needle 1, and a position corresponding to FIGS. 12 and 13 will be attained. Once respective fillings 43 are inserted, a leno weave as shown in FIG. 4 will be produced.

Obviously the drive motor 28 may be controlled in such manner that the device 13 is not laterally displaced at every insertion but only after predetermined insertions. In such a case a leno fabric will be produced such that the warps of the warp sheets 37 and 38 do not constitute a leno weave around each filling 43 but only after a set of several fillings. Obviously too, the device 13 need not be moved from the uppermost to the lowermost and then again into the uppermost position for each filling insertion. Said motion may take place after a predetermined number of filling insertions. Again, combinations of the above described displacements are manifestly feasible. If the drive motor 28 is controlled to implement lateral displacement in both directions of the device 13 relative to said up-and-down motions, then warps of the warp sheet 37 may be moved into the lowermost position of the drive 13 on the desired side of the needles 1 in order to attain the desired leno weave.

The preferred production of a leno fabric 42 is carried out by displacing the device 13 in opposite lateral directions during each insertion and moving the device 13 in one up-and-down motion between each insertion, because in such a case a well-woven leno fabric 42 will be attained. Such a leno fabric 42 is particularly well-suited as carpet backing. This design offers also the advantage that the drive motor 28 may rotate at nearly constant speed in a single direction, said speed being synchronous with the weaving machine speed at half the weaving machine average speed. The speed of the drive motor 28 need not be absolutely synchronous with the continuously varying weaving-machine speed. It need only be synchronous on average with the weaving-machine speed. This feature also illustrates that the drive motor 28 must be driven in such a way that the warps of the warp sheet 37 guided by the device 13 are positioned on the desired side of the needles 1 that the warps just pass during their upward motion. Between the two times mentioned above, the said device may assume practically any lateral position. It is preferred however that the device 13 shall be in a lateral position whereat, to the extent possible, the warps do not rest against the needles 1 in order to limit warp and needle wear resulting from friction between said warps and needles 1. Consequently, and as regards the above described embodiment, the cam 25 is rotated 180° by the drive motor 28, for instance, for one insertion of a filling, said drive motor 28 operating at variable speed. Said variable speed may be adjusted in such a way that the device 13 shall move substantially laterally during a time when said device 13 is substantially situated at the lowest position below the needles 1.

Figure 14:
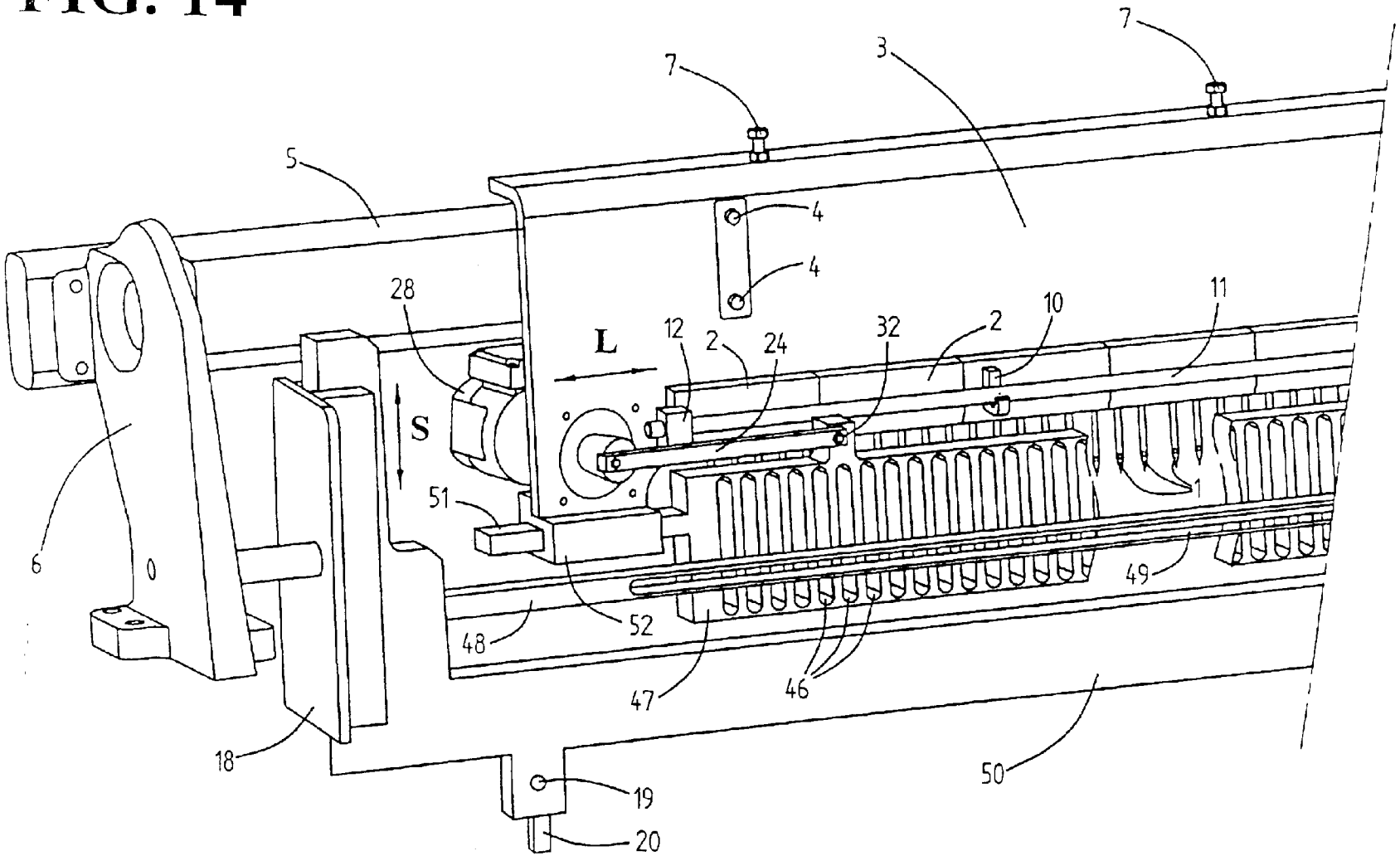
FIG. 14 is a further embodiment of the equipment of the invention.

In the embodiment of FIG. 14, the device corresponding to warp moving device 13 is displaceable transversely and parallel to the needles 1 and is divided into two elements 47 and 48. The first element 47 is fitted with guide slits 46 running parallel to the needles 1. This element 47 is moved to-and-fro transversely relative to the needles in the direction of the arrow L by means of a drive motor 28 affixed to the support plate 3 and a cam drive using a connecting rod. The warps running through the guide slits moreover are guided in a transverse guide slot 49 of the second element 48 which by means of side parts and a cross-brace 50 is guided in guides 18 and is driven into motions parallel to the needles 1 in the direction of the arrow S. The guide slits 46 and the slot 49 define guide eyes for the warps of the warp sheet 37 that are moved relative to the needles 1. The element 47 is fitted with tang-like protrusions 51 extending in guides 52 affixed to the support plate 3.

Figure 15:
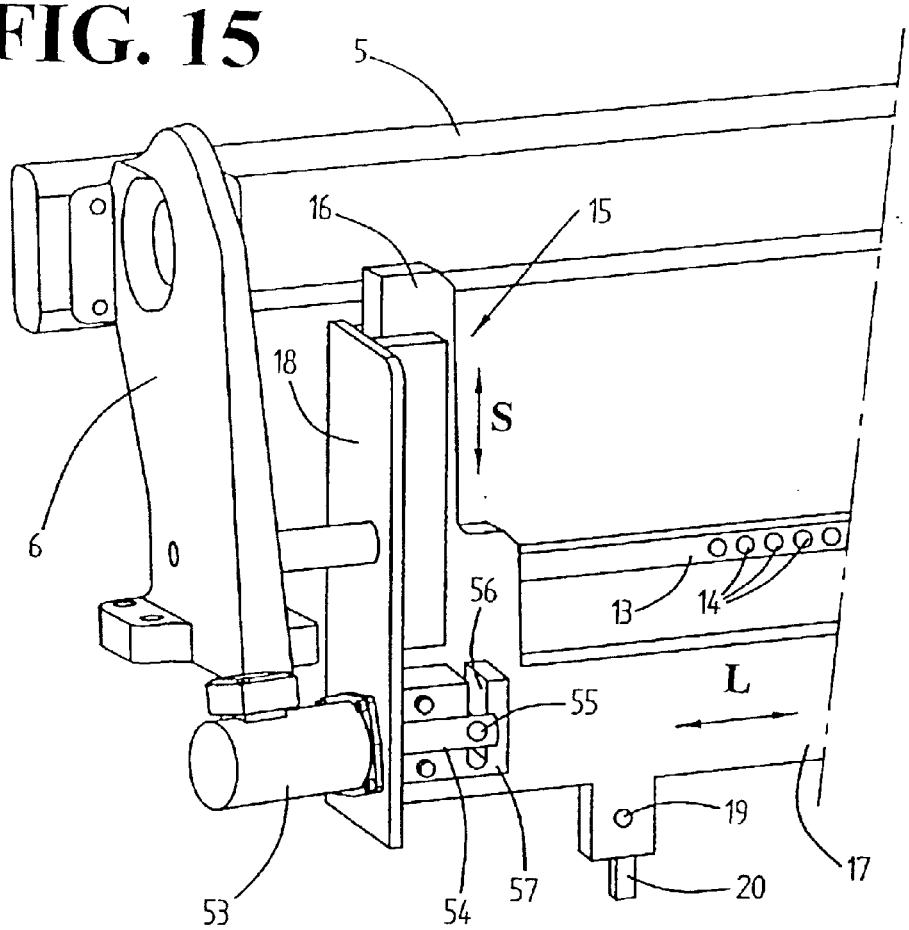
FIG. 15 shows a modified embodiment of a drive system implementing the transverse motion.

FIG. 15 shows an embodiment which, except for the drive system for the transverse motion of the device 13, corresponds with the embodiment of FIG. 1. A controlled linear motor 53 is mounted on the base plate of the guide 18 and drives an extensible plunger 54 fitted with a transverse stud 55. The stud 55 engages a slot 56 running in the direction of excursion of the frame 15 and that is part of a guide block 57 affixed to a lateral part 16 of the frame 15. The linear motor 53 is powered according to an appropriately adjusted speed function and enables laterally displacing the frame 15 toward the needles in a manner such that friction arises only in a restricted way between the warps and the needles 1. When the frame 15 moves up-and-down, the stud 55 slides inside the slot 56.

In accordance with another embodiment (not shown), the up-and-down motion of the frame 15 also may be implemented using its own motor, illustratively a linear motor. Further alternatively, this motion may be driven by another shaft of the weaving machine, for instance the lay shaft.

Figure 16:
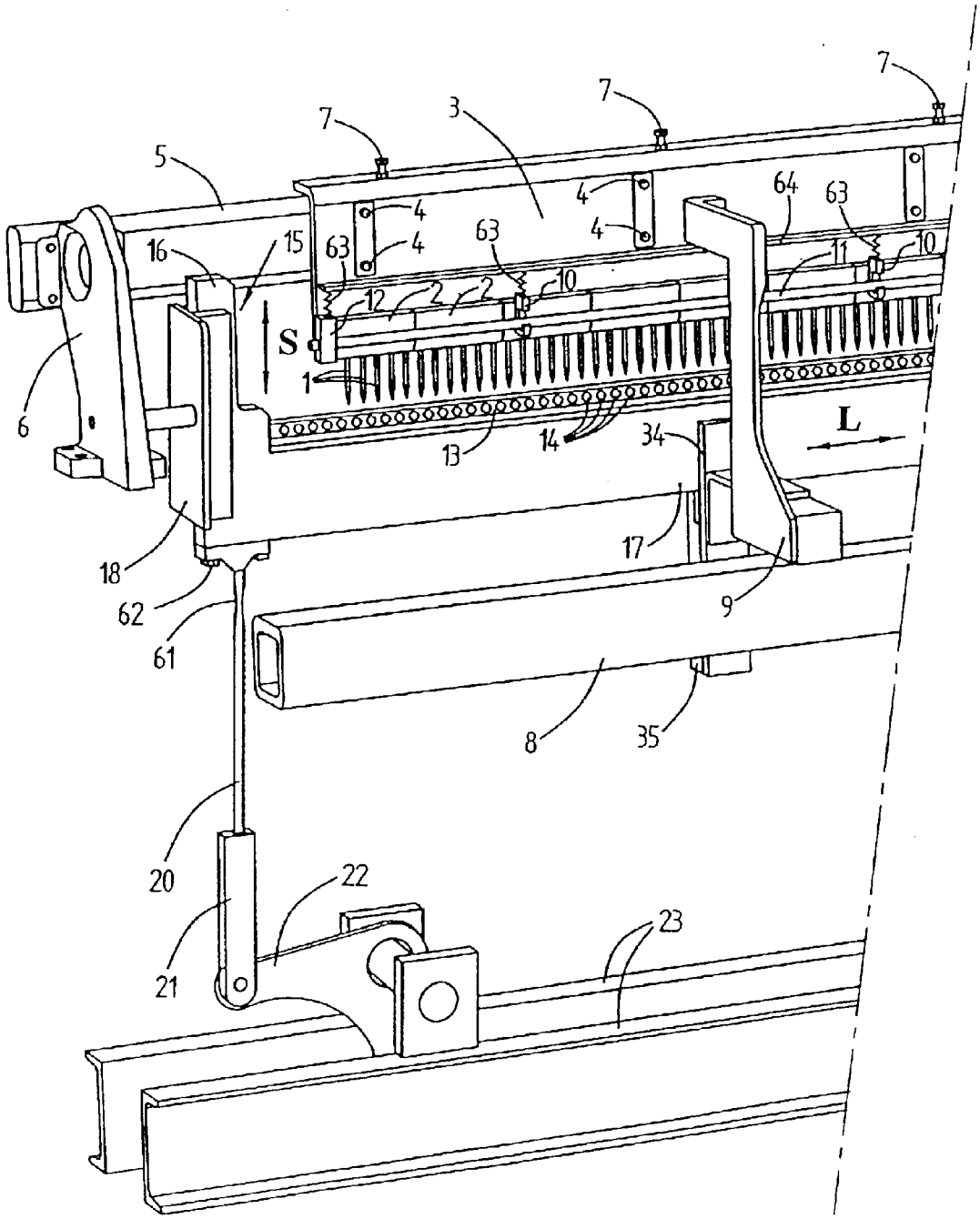
FIG. 16 is a view similar to FIG. 1 of a further embodiment of the invention.

In the embodiment of FIG. 16, the deflecting rod 11 is resiliently affixed to the support plate 13. For that purpose the clamp 12 and the supports 10 are guided in guides running parallel to the needles 1 and are suspended by springs 63 from a support element 64 of the support plate 3. In this manner changes in tension in the sheet of warps 38 may be limited.

As a feature of the embodiment of FIG. 16, the connecting rod 20 is not linked in an articulating manner to the frame 15. The connecting rod 20 resiliently deforms (flexes) and consequently an articulation element may be omitted. Preferably the connecting rod 20 has a defined bending location in the form of a constriction 61. In this embodiment the connecting rod 20 shall then be rigidly affixed by a support 62 to the frame 15.

In a modified embodiment (not shown), the deflecting rod 11 is affixed to the frame 15 at the top. In another embodiment variant (not shown), individual thread guides are affixed at the top of the frame instead of using a deflecting rod 11.

In accordance with another embodiment (not shown), the device 13 or the element 47 may be actuated by the weaving machine's main drive. Such a drive consists for instance of a cam powered from a shaft of the weaving machine and connected by connecting rods to the device 13 or the element 47. However such a design restricts the latitude for varying the leno weave variations.

Even though the present invention has been discussed in relation to an airjet weaving machine, its application shall not be restricted to such example. The invention is easily applicable to other weaving machines such as gripper weaving machines, gripper shuttle weaving machines, waterjet weaving machines, projectile weaving machines or other weaving machines. The invention offers the advantage that the system can be retrofitted in a problem-free manner on any weaving machine.

The above described embodiment modes are merely illustrative and the present invention also may be implemented in problem-free manner in other variations.

What is claimed is:

1. Apparatus for producing a leno fabric, comprising a plurality of juxtaposed needles each fitted with one needle guide eye for a warp and furthermore a plurality of juxtaposed moveable guide eyes defined by a warp moving device drivable so as to be displaced periodically relative to the stationary needles in the longitudinal needle direction and transversely thereof, and guides arranged to cooperate with and to guide the warp moving device during longitudinal displacements of the warp moving device occurring along the longitudinal direction of the needles and during transverse displacements of the warp moving device occurring transversely of the needles, said warps extendable through the movable guide eyes being displaced below and along either side of the stationary needles by the relative motion of the warp moving device;

said guides constraining movement of the warn moving device along the warp direction.

2. Apparatus as claimed in claim 1, including a plurality of said guides mounted in a distributed manner across the width of the apparatus.

3. Apparatus as claimed in claim 1, wherein the needles point from top to bottom relative to a warp sheet and are located so as to receive the warps of a warp sheet constituting the lower side of a weaving shed.

4. Apparatus as claimed in claim 1, including a plurality of supports disposed one behind the other across the apparatus width; said supports carried by a support plate; and a plurality of needles carried by each support.

5. Apparatus as claimed in claim 1, including a drive system for the warp moving device comprising a drive motor connected to and carried by the warp moving device and arranged to effect transverse motions of the warp moving device.

6. Apparatus as claimed in claim 5, wherein the drive system comprises an adjustable cam drive.

7. Apparatus as claimed in claim 5, wherein said motor is a linear motor.

8. Apparatus for producing a leno fabric, comprising a plurality of juxtaposed needles each fitted with one needle guide eye for a warp and furthermore a plurality of juxtaposed moveable guide eyes defined by a warp moving device drivable so as to be displaced periodically relative to the stationary needles in the longitudinal needle direction and transversely thereof, and guides arranged to cooperate with and to guide the warp moving device during longitudinal displacements of the warp moving device occurring along the longitudinal direction of the needles and during transverse displacements of the warp moving device occurring transversely of the needles, said warps extendable through the movable guide eyes being displaced below and along either side of the stationary needles by the relative motion of the warp moving device;

wherein the warp moving device comprises two displaceable elements movable relative to each other and of which one element is displaceable transversely of the longitudinal direction of the needles and comprises guide slits running parallel to the needles and wherein the other element is displaceable parallel to the needles and includes a transverse guide slot the guide slits running parallel to the needles and the transverse guide slot together defining said movable guide eyes.

9. Apparatus as claimed in claim 8, including a warp deflecting rod affixed in resilient manner so as to be movable in a direction extending toward the needle guide eyes and located on a side of the needles thereof facing the warp moving device, said deflecting rod arranged to support warp threads extendable through the needle guide eyes.

10. Apparatus as claimed in claim 9, including a plurality of supports disposed one behind the other across the apparatus width; said supports carried by a support plate; and wherein the deflecting rod is carried by the support plate and several deflecting rod support elements are carried by the support plate and distributed along the length of the deflecting rod.

* * * * *